US008664575B2

(12) United States Patent
Bril et al.

(10) Patent No.: US 8,664,575 B2
(45) Date of Patent: Mar. 4, 2014

(54) MINIATURE MISSILE

(75) Inventors: Yariv Bril, Kiryat Motzkin (IL); Yakov Hetz, Yokneam Moshava (IL); Oded Yehezkeli, Kiryat Tivon (IL); Ehud Chishinsky, Nofit (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 752 days.

(21) Appl. No.: 12/377,604

(22) PCT Filed: Aug. 16, 2007

(86) PCT No.: PCT/IL2007/001028

§ 371 (c)(1),
(2), (4) Date: Sep. 5, 2010

(87) PCT Pub. No.: WO2008/020448

PCT Pub. Date: Feb. 21, 2008

(65) Prior Publication Data

US 2010/0320312 A1 Dec. 23, 2010

(30) Foreign Application Priority Data

Aug. 16, 2006 (IL) ..... 177527

(51) Int. Cl.

| | |
|---|---|
| ***F41G 7/22*** | (2006.01) |
| ***F42B 10/62*** | (2006.01) |
| *F41G 7/00* | (2006.01) |
| *F42B 10/00* | (2006.01) |

(52) U.S. Cl.
USPC ..... 244/3.15; 244/3.1; 244/3.16; 244/3.19; 244/3.24; 342/61; 342/62; 89/1.11

(58) Field of Classification Search
USPC ..... 342/61, 62; 244/3.1–3.3; 89/1.11
See application file for complete search history.

(56) References Cited

U.S. PATENT DOCUMENTS

| | | | | |
|---|---|---|---|---|
| 2,512,693 | A * | 6/1950 | Sparks, Jr. et al. | 244/3.19 |
| 3,065,931 | A * | 11/1962 | Dixon et al. | 244/3.16 |
| 3,631,485 | A * | 12/1971 | Beazell, Jr. | 244/3.19 |
| 3,746,281 | A | 7/1973 | Stripling | |
| 3,756,538 | A * | 9/1973 | McLean | 244/3.16 |
| 4,037,806 | A | 7/1977 | Hirsch et al. | |
| 4,093,154 | A * | 6/1978 | McLean | 244/3.16 |

(Continued)

FOREIGN PATENT DOCUMENTS

| | | |
|---|---|---|
| DE | 2815206 | 10/1979 |
| EP | 0559548 | 9/1993 |

(Continued)

OTHER PUBLICATIONS

Python-4 AAM; DEFENCETALK by Editor on Sunday, Jan. 23rd, 2005; Http./www.defencetalk.com/python-4-aam-17059/. publication XP055 071836.

*Primary Examiner* — Bernarr Gregory
(74) *Attorney, Agent, or Firm* — Mark M. Friedman

(57) ABSTRACT

A miniature lightweight high-maneuverability missile (10) has a missile body (12) with three sets of at least two aerodynamic control surfaces (14, 16, 18) for independent control of roll, pitch and yaw of the missile. Each set of control surfaces (14, 16, 18) is independently controlled by a corresponding actuator (20) deployed within the missile body (12). Other preferred features include selection of an elevation angle of incidence at a target, and switching between explosive and kinetic modes of operation.

41 Claims, 8 Drawing Sheets

(56) References Cited

U.S. PATENT DOCUMENTS

| | | | | | |
|---|---|---|---|---|---|
| 4,168,813 | A | | 9/1979 | Pinson et al. | |
| 4,189,116 | A | * | 2/1980 | Ehrich et al. | 244/3.16 |
| 4,264,907 | A | * | 4/1981 | Durand et al. | 244/3.19 |
| 4,318,515 | A | | 3/1982 | Leel | |
| 4,381,090 | A | * | 4/1983 | Garner | 244/3.16 |
| 4,457,475 | A | | 7/1984 | Ahlstrom | |
| 4,796,834 | A | | 1/1989 | Ahlstrom | |
| 5,064,141 | A | * | 11/1991 | Nesline, Jr. | 244/3.15 |
| 5,201,895 | A | * | 4/1993 | Grosso | 244/3.16 |
| 5,322,243 | A | * | 6/1994 | Stoy | 244/3.24 |
| 5,323,987 | A | * | 6/1994 | Pinson | 244/3.16 |
| 6,138,944 | A | * | 10/2000 | McCowan et al. | 244/3.13 |
| 6,244,535 | B1 | | 6/2001 | Felix | |
| 6,308,911 | B1 | | 10/2001 | Schroeder | |

FOREIGN PATENT DOCUMENTS

| | | |
|---|---|---|
| EP | 1674819 | 6/2006 |
| GB | 2177668 | 1/1987 |
| JP | H03208796 | 9/1991 |
| JP | 2000249500 | 9/2000 |
| WO | 2004097541 | 11/2004 |

* cited by examiner

FIG. 1
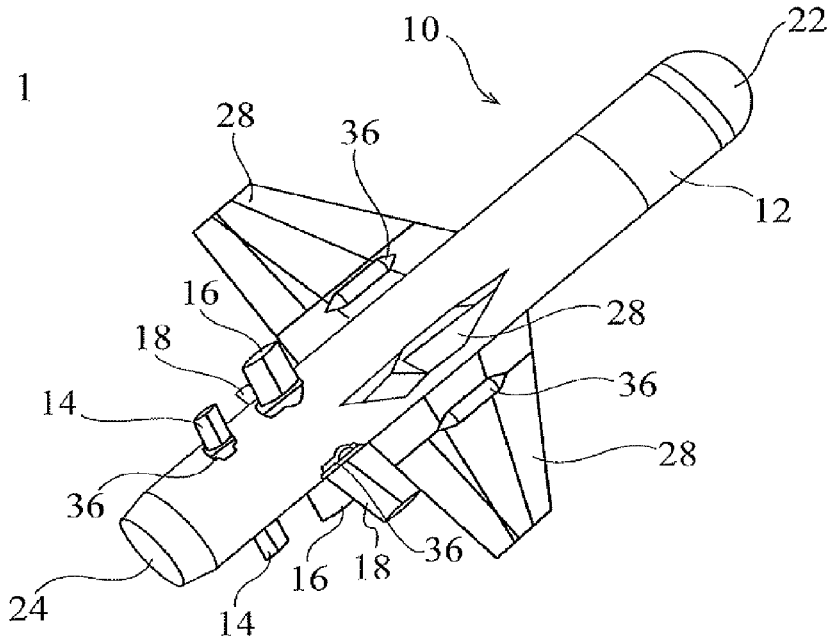
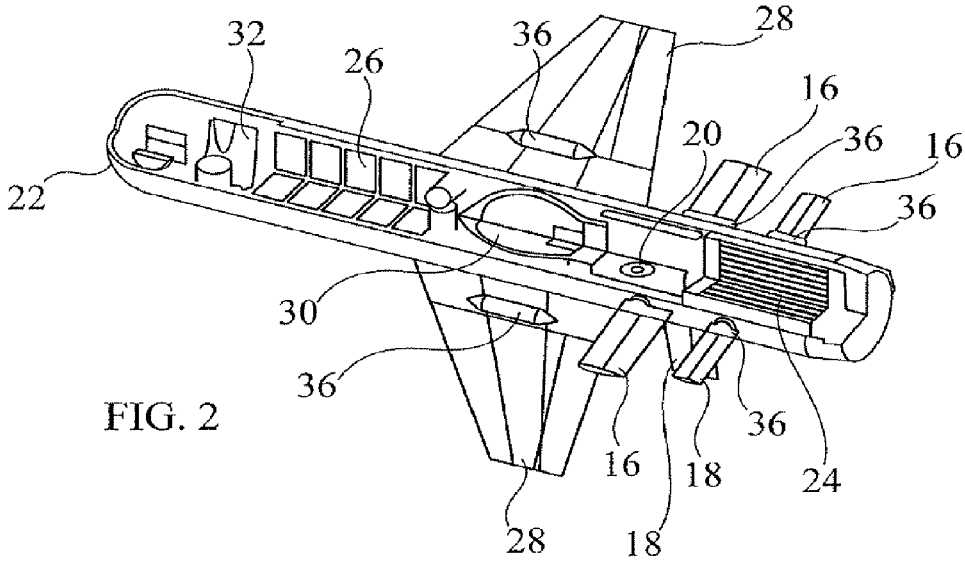
FIG. 2

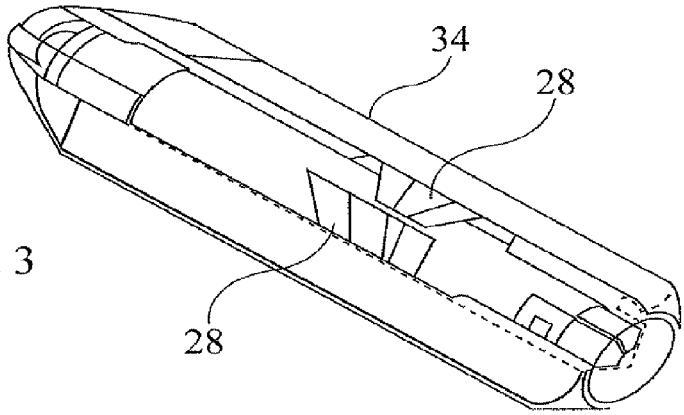
FIG. 3
FIG. 4A
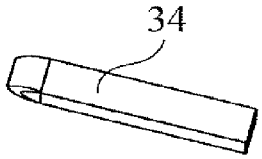
FIG. 4C
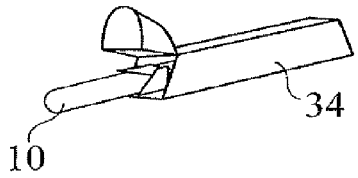
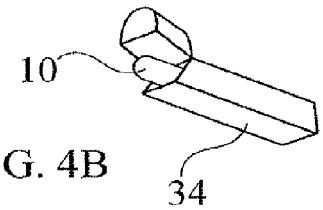
FIG. 4B
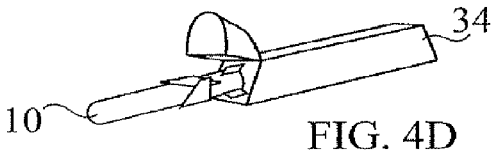
FIG. 4D
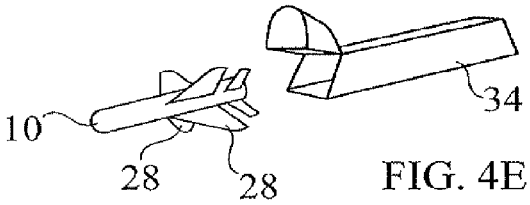
FIG. 4E FIG. 10A
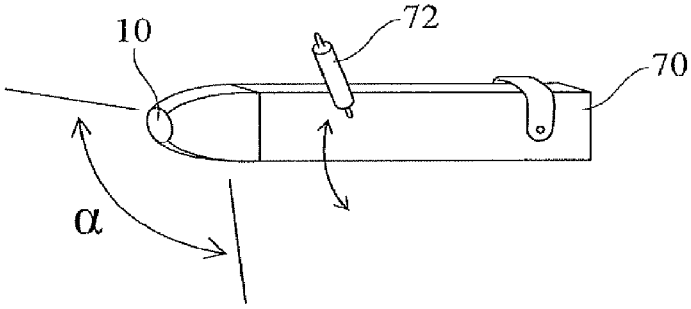
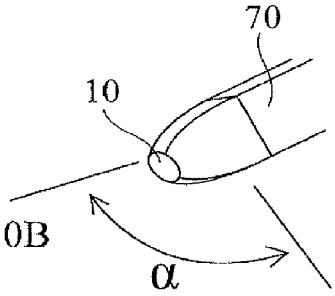
FIG. 10B
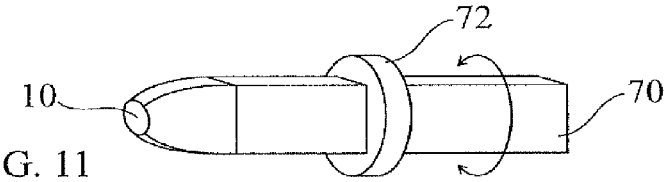
FIG. 11
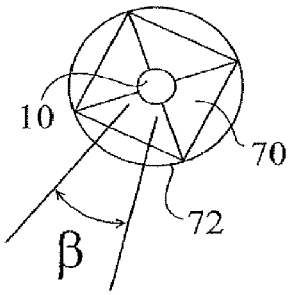
FIG. 12A
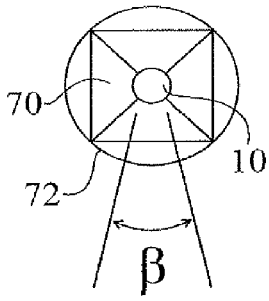
FIG. 12B
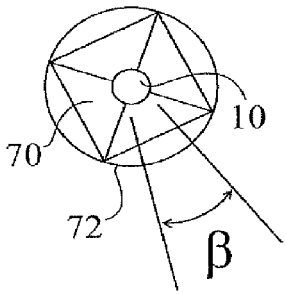
FIG. 12C

MINIATURE MISSILE

RELATED APPLICATIONS

This patent application is a U.S. National Phase Application of PCT/IL2007/001028 filed on Aug. 16, 2007, and also claims the benefit of IL 177527 filed Aug. 16, 2006 the contents of which are incorporated herein by reference.

FIELD AND BACKGROUND OF THE INVENTION

The present invention relates to target-seeking missiles and, in particular, it concerns a miniature target-seeking missile for attacking surface targets, and corresponding methods of operation of a missile.

Various types of target-seeking missiles have been developed to address differing operational needs in modern warfare, each characterized by particular combinations of features. In general, missiles for targeting aircraft (i.e., air-to-air missiles and surface-to-air missiles) require extremely high speeds, typically in the range of 3-4 mach, in order to close in upon a fast-moving target. Particularly in the case of air-to-air missiles, high seeker gimbal angles and high maneuverability are also required in order to facilitate targeting of an enemy aircraft which is at a high angle off boresight. In order to maintain aerodynamic stability under these extreme operating conditions, some of the most recent generations of air-to-air missiles employ three or more independently controlled sets of symmetrically deployed aerodynamic control surfaces, particularly to allow independent management of the sensitive roll control-loop of the missile in flight. Thermal imaging seekers typically cover wide angles approaching full hemispherical coverage. The missiles are typically large, often with a pre-launch weight in the region of 100 kg.

Guided missiles for targeting surface targets (i.e., air-to-surface and surface-to-surface missiles) are configured for very different operating conditions, and therefore differ greatly from air-to-air missiles. For example, missiles for targeting surface targets typically do not require such high speeds, and are typically subsonic or at most around the speed of sound. Many guided missiles provide capabilities for following progress of the missile in flight and correcting, or even changing, the target during flight. Particularly in such cases, relatively slow speeds are preferred to allow time for controlling the missile. The combination of lower speeds, lower maneuverability and often relatively high weight avoid many of the problems of aerodynamic control, particularly of the roll parameter, present in air-to-air missiles. As a result, missiles for surface targets commonly employ a set of four fins for controlling pitch, yaw and roll.

A further distinction between missiles for surface targets and those for airborne targets is the range of seeker gimbal angles required. Surface-to-surface missiles and air-to-surface missiles typically home-in towards a target which is itself stationary or relatively slow moving. This ensures that the target is always more-or-less ahead of the missile, thereby allowing the use of imaging seekers with relatively small gimbal deflection angles, such as about ±30°.

At the small end of the scale of surface-to-surface guided missiles are man-portable or man-packable missiles which try to bring the capabilities of precision attack weapons to the infantry arena. Shoulder-launched anti-tank missiles are already well established, but their high price tag (typically in excess of US $40,000) limits their use to high-value or strategic targets. In order to provide a lower-cost option which would be suitable for lower-value "soft" targets, attempts have been made to scale-down and simplify missiles along the same conceptual lines as the anti-tank missiles to provide a miniature guided missile for mass production as an infantry weapon.

One recent example of these attempts is described in U.S. Pat. No. 6,244,535 to Felix. Felix describes a low cost miniature missile for use against low-value "soft" targets. The missile is described as having a weight of about 2 kg, length of about 46 cm, and body diameter of about 4 cm. It is driven by a low-speed rocket motor and employs 3 or 4 canards for aerodynamic control which are said to generate lateral accelerations of up to between 4 G and 8 G at 220 m/s. The missile implements a reduced performance navigation law based on a "simplified" guidance system. For target tracking, the missile employs a fixed (non-gimbaled) imaging sensor with a frame rate below 15 Hz in order to reduce costs and simplify processing. The fixed imaging sensor requires use of a non-optimal flat fly-out trajectory in order to avoid losing the target from the edge of the field of view. The missile operates in a "fire-and-forget" modality with inferior ("simplified") tracking algorithms based on two-dimensional edge detection algorithms only.

For short range targets, situations frequently arise where the location of a desired target is well known but the target is obscured from view from the launching position. The missile of Felix, limited to "fire-and-forget" modality, clearly cannot be used against obscured targets. Furthermore, the flat fly-out trajectory of the Felix missile results in a line of sight close to the ground which is susceptible to momentary disruption by intervening objects during flight, thereby risking target tracking failure.

For longer ranges, it is known to use anti-tank missiles to attack a target which is obscured from direct view of the launch location. Such situations are typically classified in the art as "BLOS" ("beyond the line of sight") for situations where the target is immediately behind a visible cover or "NLOS" ("no line of sight") for situations where some intervening object (e.g., a hill or building) obscures the region of the target. In either case, the target can be attacked by launching a missile along an elevated flight path until the obscuring obstacle no longer obstructs view of the target and then locking-on to the target. In a BLOS scenario, the missile is typically initially locked-on to the cover or another object adjacent to the target and then the target is updated ("fire-and-update") when the target comes into view. For NLOS scenarios, the missile is typically launched along an initial flight path under inertial guidance and locks on to the target during flight (LOAL-"lock-on-after-launch"). For shorter ranges, however, existing surface-to-surface missiles lack sufficient maneuverability to start along a high flight path and still bend the flight path down sharply enough to reach the target. The problem becomes even more pronounced where a target is located immediately behind a shielding structure such as a wall or building so that it may not become clearly visible until the missile is almost overhead. Additionally, in the modern warfare arena, there is a growing need for pinpoint attack capabilities which can target terrorists or other specific localized threats located within a civilian environment with the minimum possible collateral damage.

There is therefore a need for a small guided missile which would provide an effective solution for short range obscured targets, and which would allow pinpoint targeting of small targets with reduced collateral damage.

SUMMARY OF THE INVENTION

The present invention is a miniature target-seeking missile for attacking surface targets, and corresponding methods of operation of a missile.

According to the teachings of the present invention there is provided, a miniature target-seeking missile comprising: (a) a missile body; (b) a plurality of aerodynamic surfaces associated with the missile body, the plurality of aerodynamic surfaces including a plurality of control surfaces for controlling roll, pitch and yaw of the missile; (c) a set of at least three actuators associated with the control surfaces for controlling the control surfaces; (d) a seeker arrangement associated with the missile body, the seeker arrangement including an imaging sensor mounted on a gimbal mechanism; (e) a rocket motor associated with the missile body and configured for propelling the missile up to a maximum subsonic speed; and (f) a control system including at least one processor, the control system associated with the seeker arrangement and with the set of actuators, the control system controlling the actuators so as to navigate the missile to a target, wherein the plurality of aerodynamic surfaces and the actuators are configured such that a maximum lateral deflection of the missile flight path achieves a radius of curvature of the flight path smaller than 200 meters.

According to a further feature of the present invention, the gimbal mechanism has a range of deflection extending in at least one sense to an angle of at least 80 degrees deflection relative to a boresight direction of the missile. Preferably, the gimbal mechanism has a range of deflection which is asymmetric relative to a boresight direction of the missile body, the asymmetric range of deflection extending in one direction to at least about 120 degrees off-boresight.

According to a further feature of the present invention, the rocket motor is configured for accelerating the missile to a maximum speed of at least 100 meters per second, and preferably between 130 and 180 meters per second.

According to a further feature of the present invention, the missile has a mass of no more than two-and-a-half kilograms.

According to a further feature of the present invention, the plurality of aerodynamic surfaces includes three sets of at least two control surfaces, each of the sets being independently controlled by one of the actuators for controlling a corresponding one of roll, pitch and yaw of the missile.

According to a further feature of the present invention, the at least two control surfaces of each set of control surfaces are mechanically linked so as to actuated together by one of the plurality of actuators.

According to a further feature of the present invention, the at least two control surfaces of each set of control surfaces are deployed symmetrically about a central axis of the missile body.

According to a further feature of the present invention, the maximum lateral deflection of the missile flight path generates a lateral acceleration of at least 12 G at a speed of 180 meters per second.

According to a further feature of the present invention, there is also provided a warhead deployed within the missile body.

According to a further feature of the present invention, there is also provided an inertial navigation system associated with the processor.

According to a further feature of the present invention, the processor is configured to navigate the missile after launch according to an inertially defined flight path.

According to a further feature of the present invention, there is also provided a wireless communications link associated with the processor for transmitting images from the imaging sensor to a remote location.

According to a further feature of the present invention, the plurality of aerodynamic surfaces are configured such that, during descent through air, a terminal velocity of the missile is subsonic.

According to a further feature of the present invention, the plurality of aerodynamic surfaces include a plurality of folding aerodynamic surfaces assuming a folded state for deployment within a canister and configured to open after launch to a deployed state.

According to a further feature of the present invention, the control system is configured for navigating the missile along a flight path so as to reach the surface target at an incident elevation angle of greater than 75 degrees.

According to a further feature of the present invention, the control system is configured to switch between a plurality of modes for navigating the missile to a given surface target along any one of a plurality of flight-path types.

According to a further feature of the present invention, a first of the flight-path types is configured to achieve a higher maximum altitude than a second of the flight-path types.

According to a further feature of the present invention, each of the plurality of flight-path types is configured to achieve a corresponding desired incident elevation angle at the surface target.

There is also provided according to the teachings of the present invention, a miniature missile system including the aforementioned miniature target-seeking missile and a hand-held launcher for receiving and launching the missile, the launcher defining a launching direction of the missile, the control system being configured to select one of the plurality of flight-path types as a function of at least an elevation angle at which the launching direction is held prior to launching of the missile.

There is also provided according to the teachings of the present invention, a miniature missile system including the aforementioned miniature target-seeking missile and a hand-held launcher for receiving and launching the missile.

According to a further feature of the present invention, the launcher is configured to eject the missile prior to operation of the rocket motor with a momentum no greater than 20 kg·m/s.

According to a further feature of the present invention, the launcher includes an ejector mechanism for ejecting the missile without releasing a rearward flame.

According to a further feature of the present invention, the missile and the launcher further include components of a wireless communications link, and wherein the launcher includes a display for displaying images from the imaging sensor transmitted via the wireless communications link, and wherein the launcher further includes a user input device for updating a currently tracked target within the images for transmission via the wireless communications link as a target update input to the missile.

According to a further feature of the present invention, there is also provided a controller subsystem separate from the launcher, the controller subsystem including a display for displaying images output from the imaging sensor and a user input device for updating a currently tracked target within the images.

According to a further feature of the present invention, the controller subsystem and the missile include components of a wireless communications link, transmission of the images from the missile to the controller subsystem and transmission of the user input from the controller subsystem to the missile being performed via the wireless communications link.

According to a further feature of the present invention, the controller subsystem includes a mobile computer, and wherein the user input device includes a click-to-select pointing device.

There is also provided according to the teachings of the present invention, a miniature missile system including the aforementioned miniature target-seeking missile and a launcher for receiving and launching the missile, the launcher being configured for mounting on an airborne platform.

According to a further feature of the present invention, the launcher includes: (a) a canister for at least partially containing the missile before launch; and (b) a canister displacement mechanism selectively operable to displace the canister relative to the airborne platform through a motion including a component of rotation so as to facilitate locking on with the seeker arrangement to a target.

According to a further feature of the present invention, the motion includes a component of rotation about an axis substantially parallel to a central axis of the missile body.

According to a further feature of the present invention, the motion includes a component of rotation about an axis substantially perpendicular to a central axis of the missile body.

There is also provided according to the teachings of the present invention, a missile system comprising: (a) a target-seeking missile including a control system having a programmable data storage device for storing a software component of the control system; (b) a first launcher for launching the target-seeking missile, the first launcher including a first version of the software component for configuring the control system to navigate the target-seeking missile according to a first set of navigation rules, and a data connection for uploading the first version of the software component into the programmable data storage device; and (c) a second launcher for launching the target-seeking missile, the second launcher including a second version of the software component for configuring the control system to navigate the miniature target-seeking missile according to a second set of navigation rules, and a data connection for uploading the second version of the software component into the programmable data storage device, such that the target-seeking missile navigates according to the first set of navigation rules if launched from the first launcher and according to the second set of navigation rules if launched from the second launcher.

According to a further feature of the present invention, the first launcher is a hand-held launcher, and wherein the first set of navigation rules are configured for surface-to-surface flight paths.

According to a further feature of the present invention, the second launcher is configured for mounting on an airborne platform, and the second set of navigation rules are configured for air-to-surface flight paths.

There is also provided according to the teachings of the present invention, a method for operating a surface-to-surface missile comprising: (a) providing a target-seeking missile configured to selectively navigate to a target according to any of at least two flight-path types, a first of the flight-path types attaining a higher maximum altitude for a given target than a second of the flight-path types, the target-seeking missile being deployed within a launcher which defines a launching direction, the launcher being displaceable to allow variation of an elevation angle of the launching direction; (b) detecting a current elevation angle of the launching direction prior to launching of the missile; (c) if the current elevation angle lies within a first range of launch-pose angles, selecting the first flight-path type; and (d) if the current elevation angle lies within a second range of launch-pose angles, selecting the second flight-path type.

There is also provided according to the teachings of the present invention, a missile for use against a target comprising: (a) a missile body; (b) an explosive charge deployed within the missile body; (c) a communications link for receiving a switching command from a remote location; and (d) a remotely controlled fuze arrangement associated with the explosive charge and the communications link, the remotely controlled fuze arrangement being responsive to the switching command to switch during flight of the missile between at least two states including: (i) an armed state for detonation of the explosive charge against the target, and (ii) a disabled state in which the missile impacts the target as a kinetic shell.

According to a further feature of the present invention, there is also provided an imaging sensor associated with the missile body and the communications link, and wherein the communications link is configured to transmit images from the imaging sensor to a remote location.

According to a further feature of the present invention, the missile is part of a missile system which also includes a remote controller unit including: (a) a communications link for communicating with the missile; (b) a display associated with the communications link and configured to display the images from the imaging sensor; and (c) a user input device for inputting the switching command for transmission to the missile.

According to a further feature of the present invention, the missile is a target-seeking missile having a mass no greater than two-and-a-half kilograms.

There is also provided according to the teachings of the present invention, a method for operating a missile carrying an imaging sensor, an explosive charge and a switchable fuze arrangement against a target, the method comprising the steps of: (a) providing images from the imaging sensor to a remote operator; (b) receiving from the remote operator a switching input; and (c) responsive to the switching input, switching the fuze arrangement between at least two states including: (i) an armed state for detonation of the explosive charge against the target, and (ii) a disabled state in which the missile impacts the target as a kinetic shell.

According to a further feature of the present invention, the armed state is configured to detonate the explosive charge immediately on impact of the missile against a target.

According to a further feature of the present invention, the remotely controlled fuze arrangement is further switchable in response to the switching command to a delayed detonation state in which the fuze arrangement detonates the explosive charge a given period after impact.

According to a further feature of the present invention, the armed state is configured to detonate the explosive charge a given period after impact.

BRIEF DESCRIPTION OF THE DRAWINGS

The invention is herein described, by way of example only, with reference to the accompanying drawings, wherein:

FIG. 1 is a schematic isometric view of a missile, constructed and operative according to the teachings of the present invention;

FIG. 2 is a partially cut-away isometric view of the missile of FIG. 1;

FIG. 3 is a partially cut-away isometric view of the missile of FIG. 1 with aerodynamic surfaces folded and deployed within a launcher;

FIGS. 4A-4E are schematic isometric views showing successive stages during launching of the missile of FIG. 1 from the launcher;

FIG. 10A is a schematic representation of an implementation of the launcher of FIG. 8 including a displacement mechanism for displacing a launch canister through a motion including a component of rotation about an axis substantially perpendicular to a central axis of the missile body;

FIG. 10B is a schematic partial representation of the launcher of FIG. 10A after completion of the motion;

FIG. 11 is a schematic representation of an alternative implementation of the launcher of FIG. 8 including a displacement mechanism for displacing a launch canister through a motion including a component of rotation about an axis substantially parallel to a central axis of the missile body; and FIGS. 12A-12C are schematic front views of the launcher of FIG. 11 illustrating the use of roll of the canister prior to launch to complement a range of gimbal movement.

DESCRIPTION OF THE PREFERRED EMBODIMENTS

Figure 5A:
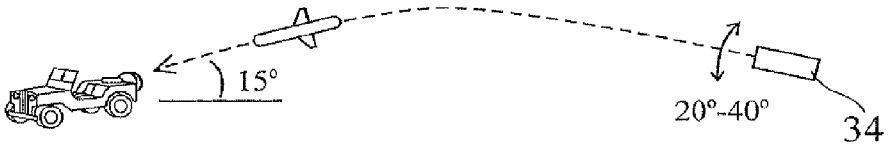
FIGS. 5A-5C are schematic representations of three different surface-to-surface flight-path types followed by the missile of the present invention according to present invention.

The present invention is a miniature target-seeking missile for attacking surface targets, and corresponding methods of operation of a missile.

The principles and operation of missiles according to the present invention may be better understood with reference to the drawings and the accompanying description.

Referring now to the drawings, FIGS. 1-5C illustrate the structure and operation of a missile, generally designated 10, constructed and operative according to the teachings of the present invention.

By way of introduction, it has been found that attempts to scale down surface-attack aerodynamic missiles to a miniature lightweight high-maneuverability missile (e.g., of weight less than two-and-a-half kilograms) tend to result in aerodynamic instability. To address this problem, it has been found that effective control and high maneuverability can be achieved with a subsonic lightweight missile by adopting various features typically associated with highly supersonic air-to-air missiles.

Thus, with reference to FIGS. 1 and 2, particularly preferred implementations of missile 10 have a missile body 12 and a plurality of aerodynamic surfaces including three sets of at least two control surfaces 14, 16, 18 for independent control of roll, pitch and yaw of the missile. Each set of control surfaces 14, 16, 18 is independently controlled by a corresponding one of a set of actuators 20, typically servo motors, deployed within missile body 12.

It should be noted that the terms "pitch" and "yaw" are used herein as the typical examples of the independently controlled planes of rotation. However, as known in the art, the independent planes may alternatively be other planes, such as intermediate axes at ±45 relative to the standard "pitch" and "yaw" axes, as in the case of an X-tail configuration. In the latter case, pure pitch would be controlled by a combination of two sets of surfaces and pure yaw would be controlled by the same two sets of surfaces operated in a different manner. In all such cases, however, it is still accurate to say that roll, pitch and yaw are controlled by three sets of at least two control surfaces, and that each set of control surfaces are independently controlled.

Missile 10 is preferably implemented with a seeker arrangement 22 associated with missile body 12, typically located at the leading tip of the body and including an imaging sensor mounted on a gimbal mechanism. A rocket motor 24 is deployed within missile body 12, typically at the rear end, for propelling missile 10. A control system 26, including at least one processor, controls actuators 14, 16, 18 so as to navigate missile 10 along a flight path towards a surface target.

Before addressing the features of preferred embodiments of the present invention in more detail, it will be useful to define certain terminology as used herein in the description and claims. Firstly, the present invention relates to a guided missile which is a target-seeking, aerodynamic missile. The term "guided missile" defines the class of projectiles which have both a propulsion system (to distinguish from guided bombs or artillery shells) and can be steered during flight (to distinguish from non-steerable rockets). The term "aerodynamic missile" defines a missile which has aerodynamic surfaces (wings or fins) which allow it to fly through the air along a non-ballistic trajectory, thereby distinguishing from ballistic missiles. The term "target-seeking" is used to refer to a missile which includes a sensor system which provides information during flight to facilitate navigating towards a desired target. In the case of the present invention, the sensor system is preferably in the form of a seeker arrangement with an imaging sensor mounted on a gimbal mechanism. The information from the sensor system may be used independently by the missile, such as in a "fire-and-forget" mode, and may additionally or alternatively be used remotely, such as in a "fire, observe and update" mode.

The present invention relates primarily, although not exclusively, to a "surface-attack missile", i.e., a surface-to-surface or air-to-surface missile, for targeting a surface target. The term "surface target" is used herein to refer to any target which is not airborne and not submersed. Thus defined, the term "surface target" includes, but is not limited to, personnel, stationary and moving vehicles, fixed structures and other objects, whether located at ground level, in or on a building, on a raised platform or at sea. It should be noted that the present invention is also useful for use against stationary or slow-moving airborne targets, such as slow flying helicopters or tethered observation balloons.

Reference is made to different "flight-path types" which may be selected for the missile of the present invention. The term "flight-path types" is used to refer to various navigation rules or parameters which specify different options for paths to be followed by the missile in flight. Thus different flight-path types applied to a given situation of target location and range will result different in different paths to be followed by the missile. The flight-path type may be defined by a particular navigation rule, by particular parameters used within a navigation rule, or by specific features of the desired flight path such as a maximum altitude to be reached or a required incident elevation angle on reaching the target. The term "incident elevation angle" is used to refer to the angle between the direction of motion of the missile when reaching the target and a horizontal plane, such that a horizontal approach would have an incident elevation angle of zero and a vertical descent would have an incident elevation angle of 90 degrees. In certain cases, a direction (compass bearing or direction relative to the launch location) may also be used to define the desired flight path.

Reference is also made to a "boresight direction" of the missile. The boresight direction is taken to be a direction defined by a central longitudinal axis passing along the body of the missile, intuitively corresponding to the "forward" direction of the missile. This direction is defined by the structure of the missile and does not necessarily correspond to the actual direction of motion of the missile in flight, which may vary according to the attack angle required for flight and other aerodynamic factors.

In certain preferred embodiments of the present invention, the gimbal movement of the seeker assembly is asymmetric relative to the boresight direction. In other words, the angular deflection of the gimbal about a given axis permits deflection to a greater angle in one direction away from boresight than in the opposing direction. In more technical terminology, it may be stated that the range of motion of the gimbal in certain preferred embodiments is asymmetric under reflection in a plane passing through the gimbal axis parallel to the boresight direction.

Most preferred implementations of the missile of the present invention include an "inertial navigation system" or "INS". The term INS is well known in the art, and refers to a navigation system based upon a full set of three linear acceleration sensors and three angular acceleration sensors, thereby fully determining the motion of the missile and allowing reliable navigation along a desired flight path. This is in contrast to many surface-attack missiles which employ a reduced set of motion sensor sufficient for implementing proportional tracking algorithms and the like. Optionally, additional systems may be used to supplement or correct drift of the INS. These may include GPS sensors or image-correlation techniques anchored to a geographic database of images.

Reference is also made to a "hand-held" surface launcher. "Hand-held" in this context refers to a device the weight of which is supported primarily or exclusively by one or both arms of an operator during use. This definition distinguishes a class of light weapons from shoulder-launched devices where the weight is primarily borne by the operator's shoulder. Typically, hand-held weapons are limited to a maximum operative weight (missile plus launcher) of no more than about 4-7 kilograms.

Reference is also made to a "launching direction" of a missile within a launcher. The "launching direction" is the direction in which the missile is ejected from the launcher, and typically corresponds closely to the boresight direction of the missile when positioned within the launcher.

Turning now to features of preferred embodiments of the present invention in more detail, missile 10 preferably has a total pre-launch weight (not including the launcher) of no more than two-and-a-half kilograms and a body diameter of between 3 and 6 cm. The missile is preferably relatively short, having a body length less than ten times the body diameter.

Missile 10 is preferably configured to be a relatively slow subsonic missile, preferably with a maximum speed no greater than 0.7 mach, and more preferably no greater than 0.6 mach. This maximum speed results from the balance of thrust from rocket motor 24 against aerodynamic drag of the missile. In addition to the aforementioned sets of control surfaces 14, 16, 18, missile 10 preferably also features a set of relatively large wings 28 which preferably extend radially outwards from missile body 12 by at least about 1.5 times the body diameter, and preferably extend at their widest part along at least a quarter of the length of missile body 12. The relatively large aerodynamic surfaces cause sufficient drag such that, during free descent through air, a terminal velocity (i.e., the maximum equilibrium velocity reached without propulsion) of the missile is subsonic, and most preferably no more than about 0.5 mach. This is particularly valuable for air-to-surface operations since it renders the closing velocity towards a target controlled and well defined substantially independent of the altitude from which the missile was launched.

Most preferably, four similar wings 28 are spaced symmetrically around missile body 12, with control surfaces 14, 16, 18 angularly spaced at intermediate angles so as to minimize aerodynamic interference between flow patterns over wings 28 and the control surfaces. Alternatively, one or two sets of control surfaces may be implemented as control flaps associated with a corresponding set of wings 28. The plurality of aerodynamic surfaces and actuators are preferably configured such that a maximum lateral deflection of the missile flight path, when in flight at the aforementioned maximum subsonic speed, achieves a radius of curvature of said flight path smaller than 200 meters. This allows the missile to achieve high incident elevation angles of attack at targets located at relatively short range, preferably allowing impact at a target at an incident elevation angle in excess of 75° for ranges from 500 meters and beyond (up to near the maximum range of the missile).

Turning now to seeker arrangement 22, the imaging sensor may be implemented either as a day-time imaging sensor (e.g., based on CCD technology) for imaging in the visible light waveband, or a night-time sensor based on a far infrared thermal imaging sensor or an image intensifying night-vision sensor in the visible waveband. In certain implementations, a dual waveband seeker with two imaging arrangements may be used.

Unlike air-to-air missiles, the surface-attack function of the present invention does not require large gimbal deflection capabilities in all directions. On the other hand, the high maneuverability and the highly curved flight paths employed in certain modes of operation of missile 10 (to be described below) require large gimbal deflection angles at least in the "down" direction of regard. For this reason, the gimbal mechanism of seeker arrangement 22 preferably has a range of deflection which is asymmetric relative to the boresight direction of the missile body, and which extends in one direction to at least about 120 degrees off-boresight. In the opposite "up" direction, a maximum deflection in the range of 20-40 degrees is typically sufficient. Lateral gimbal ranges of motion may be significantly more limited. Where necessary, the limitations of the lateral (yaw) gimbal motion can be compensated for by use of roll of the missile, either within its canister before launch or during flight, in order to turn the high-deflection gimbal direction towards the target. An implementation of use of roll of a launch canister will be described below with reference to FIGS. 11 and 12A-12C.

Missile 10 also preferably includes a warhead 30 deployed within missile body 12. Warhead 30 is preferably less than 0.7 kilograms in weight, and may be any desired type of warhead. Examples include, but are not limited to, fragmentation warheads, shaped charges, explosively formed projectile warheads, incendiary warheads, stun-grenades, and dispersal systems for other lethal or non-lethal payloads such as paint.

According to one particularly preferred aspect of the present invention, equally applicable to various other missiles carrying an explosive charge, missile 10 includes a remotely controlled fuze arrangement which is switchable by the launch-controller or an additional controller in-the-loop (as will be described below) during flight of the missile between at least two, and most preferably three, different states: an armed state for immediate detonation on impact a delayed detonation state for detonation a short period after impact (for example, half a second after penetrating through a window into a building or vehicle); and a disabled state. The latter disabled state is of particular significance in the context of the miniature and highly precise missile of the present invention by providing an option to switch the missile prior to impact to become a purely kinetic "bullet". This allows selective targeting of a small target or an individual without causing injury to people or property in close proximity to the target. This feature exhibits further synergy with the high incident angle flight-paths of the present invention by ensuring that the kinetic missile impacts the target from above, thereby minimizing the risk of the missile penetrating the intended target and continuing to cause injury to standers-by beyond the target. The possibility of converting the missile to a purely kinetic weapon during flight on the basis of real-time images returned from the missile seeker allows for completion of an intended operation under a wide range of circumstances where the operation might otherwise have needed to be aborted due to the risk of extensive collateral damage.

As mentioned earlier, preferred implementations of missile include an inertial navigation system (INS) 32 associated with the processor of control system 26. The INS may be supplemented by a global positioning system (GPS) sensor (not shown), thereby allowing the missile to navigate reliably towards a target defined by geographic coordinates. Even in such a case, in order to achieve the desired pinpoint accuracy, the closing stages of approach to a target are preferably navigated on the basis of information from the imaging sensor by pointing or locking onto a target.

Control system 26 preferably further includes a wireless communications link associated with the processor for transmitting images from the imaging sensor to a remote location. This allows for remote control of the missile's operation, such as by updating a target after launch, which is particularly important for targets which are obscured from the point of launch.

Turning now to FIGS. 3 and 4A-4E, it is a particular feature of certain preferred embodiments of the present invention that missile 10 may be stored and launched from a canister 34 which can be integrated into one or more type of launcher. In order to reduce the size of canister 34, at least some and preferably all of the aerodynamic surfaces are implemented as folding aerodynamic surfaces assuming a folded state for deployment within canister 34 (FIG. 3) and configured to open after launch to a deployed state (FIG. 1). Each wing 28 and control surface 12, 14, 16 is preferably provided with a hinge arrangement 36 to allow folding as shown and is biased by springs to assume its open state after launch. The sequence of launch of missile 10 from canister 34 and opening of the folded surfaces is depicted schematically in FIGS. 4A-4E.

Figure 6:
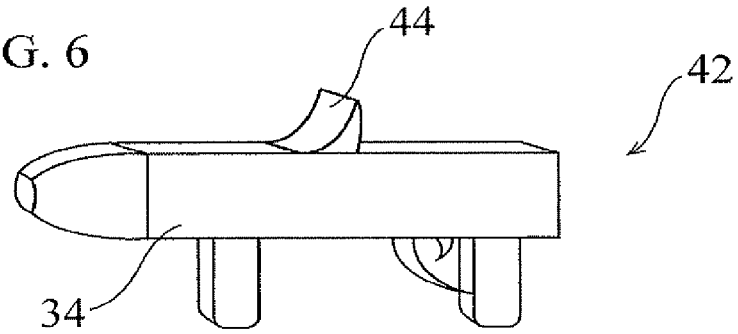
FIG. 6 is a schematic representation of a hand-held launcher for the missile of FIG. 1.

In one particularly preferred implementation of the present invention, canister 34 is integrated into a hand-held launcher 42 (FIG. 6). In order to render the missile and launcher suitable for hand-held use, the launcher is configured to eject the missile with a total momentum prior to operation of a missile propulsion unit not exceeding 20 $kg \cdot m \cdot s^{-1}$. The ejection force may be provided either by a small pyrotechnic ejection mechanism or by a non-pyrotechnic ejector mechanism of any suitable kind, including but not limited to, a purely mechanical spring arrangement and a pneumatic arrangement. In either case, the ejector mechanism is preferably configured not to generate any rearward flame or hot jet. This allows for launching of the missile at high elevation angles without risk of injury to the operator.

For a stand-alone implementation of the present invention as a hand-held weapon, a display arrangement 44 is preferably integrated into launcher 42 for displaying a targeting image, preferably corresponding to the image from the seeker system 22, for target selection prior to and/or after launch. In cases other than hand-held launchers, one or more canister 34 including a missile 10 may be incorporated into a launcher mounted on any desired platform, and the display arrangement may be located at an arbitrary location adjacent to or remote from the launcher. Examples of suitable platforms include, but are not limited to, land vehicles, airborne platforms, fixed terrestrial platforms and seaborne platforms. Certain applications exemplified in the context of an airborne platform will be discussed further below.

Figure 5B:
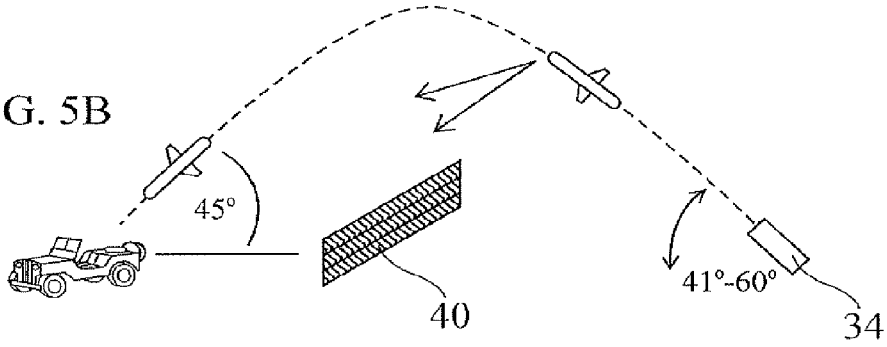
Figure 5C:
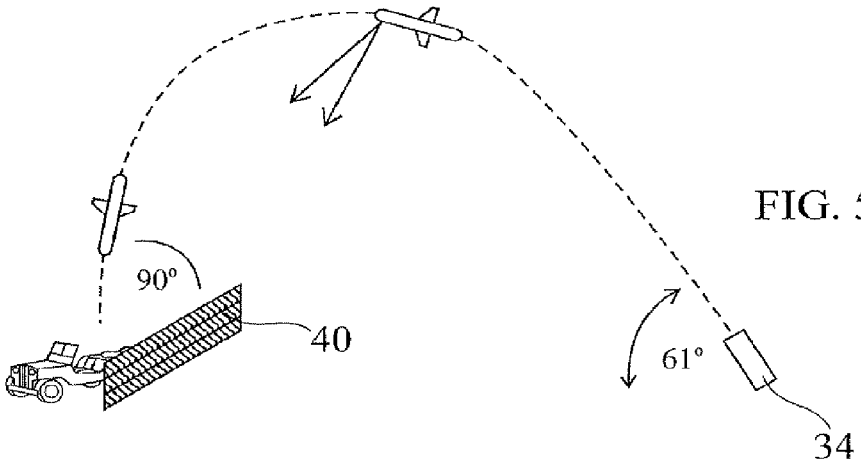

Turning now to FIGS. 5A-5C, it is a particular feature of certain particularly preferred implementations of the present invention that missile 10 and its associated launcher 34 offer a highly intuitive user interface for selecting between a plurality of flight-path types. In the specific example illustrated here, control system 26 is preferably configured to selectively navigate to a target according to any of at least two, and typically at least three, different flight-path types which attain different maximum altitudes for a given target. Optionally, section of a desired flight-path type may be performed by pressing a corresponding button, selection from a menu, or by any other conventional user interface for making a selection. More preferably, user selection of a desired one of the flight-path types is preferably performed by holding the hand-held surface launcher so that the elevation angle of the launching direction falls within a corresponding range of angles. The missile and/or launcher detects the current elevation angle of the launching direction and selects the appropriate flight-path type as a function of the current elevation angle.

The different flight-path types may be defined in various different ways. According to a first option, the flight-path types are defined by a desired incident elevation angle at which the missile should reach the target. Within operational limitations of the missile's maneuverability, this angle is preferably substantially independent of the range from the launch location to the target. Thus, by way of a non-limiting example, the missile may be configured to provide three available flight-path types: a first "low" mode configured to reach the target at a shallow incident elevation angle of about 0-30°; a second "medium" mode configured to reach the target at an intermediate incident elevation angle of about 30-75°; and a third "high" mode configured to reach the target at an incident elevation angle in excess of about 75°, and more preferably at 85°-90°, i.e., from almost directly above.

Continuing the same non-limiting example, the corresponding launcher pose angles for selecting one of these three modes may be chosen to be: 20°-40° for "low" mode 1; 41°-60° for "medium" mode 2; and over 61° for "high" mode 3. It will be noted that these angles are intuitively appropriate for the corresponding "low", "medium" and "high" flight paths, and additionally provide synergy by ensuring that the missile is launched within a range of angles which is generally suited to the flight path it is to follow. Nevertheless, it is important to note that the differing flight paths are primarily not dictated by the launch angle but rather by control system 26 which ensures that, after initial stabilization, missile 10 will follow substantially the same "medium" mode path whether it was initially launched at 45° or 55°. The ranges of elevation angle used to select the different modes are preferably non-overlapping. Typically, the selection of a flight-path type is performed after initial locking-on to an intended target. In this case, the aforementioned pose angles used to select the different modes are most preferably measured relative to the line of sight to the selected target.

It will be noted that the capability to select different height flight-paths, including options of steep incident elevation angles, provides profound operational advantages. For straight-forward line-of-site applications, the present invention provides a default "low" mode which brings the missile quickly and efficiently to the desired target. The "low" mode also allows engagement of extremely short-range targets from 50 meters upwards. The "medium" and "high" options provide valuable extra flight time for verifying and/or updating the target designation, and allow operation in BLOS and NLOS modes where the high trajectory brings the initially obscured target into view. The high angle of elevation at impact also allows highly selective targeting of an object or individual in a crowded environment, either with the warhead activated or with the warhead disabled as described above in order to minimize collateral damage.

FIGS. 5A-5C illustrate a practical application of this control. In FIG. 5A, the target is directly visible from the launcher, allowing a direct low flight path to be used. In FIG. 5B, an obstacle (wall 40) obscures the target from sight, requiring the use of a medium height flight path and lock-on after launch. In FIG. 5C, the target is located immediately behind an obstacle (wall 40), therefore requiring the use of a high flight path to open up a sufficient field of view from above to allow successful locking on to the intended target.

FIGS. 5A-5C also illustrate three different modes of operation of the missile of the present invention. FIG. 5A shows a normal "line-of-sight" mode of operation, allowing use of a "fire-and-forget" methodology. Specifically, the missile operator is presented with a display of at least part of an image from the gimbaled imaging sensor of the missile and provides a target designation input designating a location within the image as a target. In this case, the target acquisition or "lock-on" is performed prior to launch, and preferably prior to (final) selection of a flight-path type. Once locked on to a target, the missile seeker tracks the target even when the target or launcher move. The launcher is then inclined to an angle effective to select the desired flight-path type and is fired.

FIGS. 5B and 5C illustrate scenarios where a target is initially obscured from view. In the case of FIG. 5C, an object (wall 40) which is I close proximity to the desired target can be seen directly from the launching position. In this case, referred to as "beyond line-of-sight" or "BLOS", the missile may initially be locked on to a feature near the target and fired in the same manner as before. Then, after the missile has reaches a sufficiently high vantage point to see the intended target, the operator or another controller provides via the wireless communications link a target update designation input designating a location within the seeker image other than the currently tracked target and a corrected target, thereby locking the missile on to the real intended target. The control system of the missile then automatically corrects its flight path so as to navigate towards the corrected target.

Figure 7:
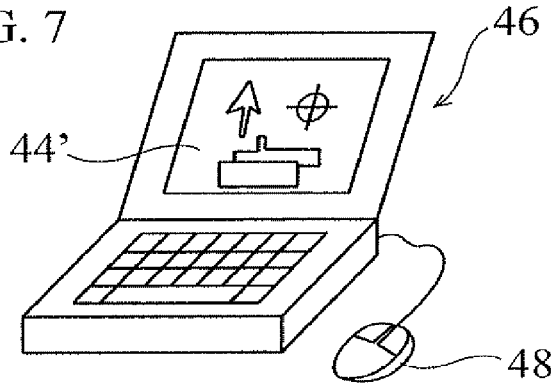
FIG. 7 is a schematic representation of a controller subsystem for use with the missile of FIG. 1.

In the scenario of FIG. 5B, on the other hand, there may be no directly viewable feature which is in close proximity to the intended target. In such cases, a "no line-of-sight" or "NLOS" approach is used. According to this approach, the missile is first launched without any prior electro-optical target acquisition, and follows a flight path according to the selected height mode and under the control of the missile's INS. Optionally, where available, the missile may employ location data for the target to navigate a pre-defined inertial flight path towards the target location. A lock-on procedure is then performed in flight, in a manner similar to the pre-launch target designation described above, allowing the missile to switch to its electro-optical target-seeking functionality. The lock-on procedure may be performed by the gunner himself, typically by using an input device such as a joystick associated with the launcher, or by a separate controller via a controller subsystem such as illustrated in FIG. 7. In either case, the launcher and/or the controller subsystem are preferably wirelessly networked with the missile, receiving real-time images transmitted from the missile via a wireless communication link and displaying them to the operator. In lock-on-after-launch operation such as NLOS, the operator (gunner or controller) typically control the direction of regard of the gimbaled imaging sensor to direct it towards the desired target and then lock on the target. Once a target is being tracked, the operator can click within the seeker image to correct the selected point of impact or to select an entirely new target. Where both the gunner and a more senior controller are "in the loop", the selection of the controller is given precedence, for example, to disable or enable the warhead, to switch targets or to abort the missile by deflection away from the target. The corresponding control signals are transferred back to the missile by wireless communications.

With regard to the user interface for the controller subsystem, it is particularly preferred that the controller subsystem includes a mobile computer 46 with a "click-to-select" pointing device 48 for the user input. The phrase "click-to-select" is used herein to refer to any conventional user input device which allows quick and accurate control of a cursor or selection of a point on a computer screen. Thus, options for the pointing device include, but are not limited to, a mouse, a joystick, a trackball, a touchpad, and a touch-sensitive screen. In the last two examples, the tap of a finger or stylus is effective as the "click-to-select" operation.

In the case of the gunner, as an alternative to the joystick option, certain embodiments of the present invention employ the hand-held launcher as a pointing device. In this case, sensors in the launcher which detect angular motion of the launcher allow the operator to change a pointing direction of the launcher in order to control the direction of regard of the gimbaled imaging sensor, a selection point within the current field of view, or the position of a currently viewed sub-window of the current field of view, depending upon the particular control process to be performed. In each case, the result of the motion is visible as a change on display 44.

Although the operation of missile 10 has been exemplified above with reference to selection of alternative flight-path types of different trajectory heights, it should be noted that the same concept may be used to select a lateral (left or right) or even rear approach to a selected target. In the case of launch from a hand-held launcher, selection of a lateral approach direction may be achieved by pointing the launch direction to the corresponding side of the line of sight to the designated target. Additional details regarding definition of such lateral approach flight paths will be discussed below in the context of airborne platform implementations with reference to FIG. 8B, and are applicable by analogy in surface-to-surface operations.

Turning now to FIGS. 8A-12C, a number of further features of the present invention will be illustrated in the context of an airborne platform. It should be noted that the present invention may be deployed on any type of airborne platform including, but not limited to, fixed wing, rotary wing and buoyancy-supported airborne platforms of all sizes.

Figure 8A:
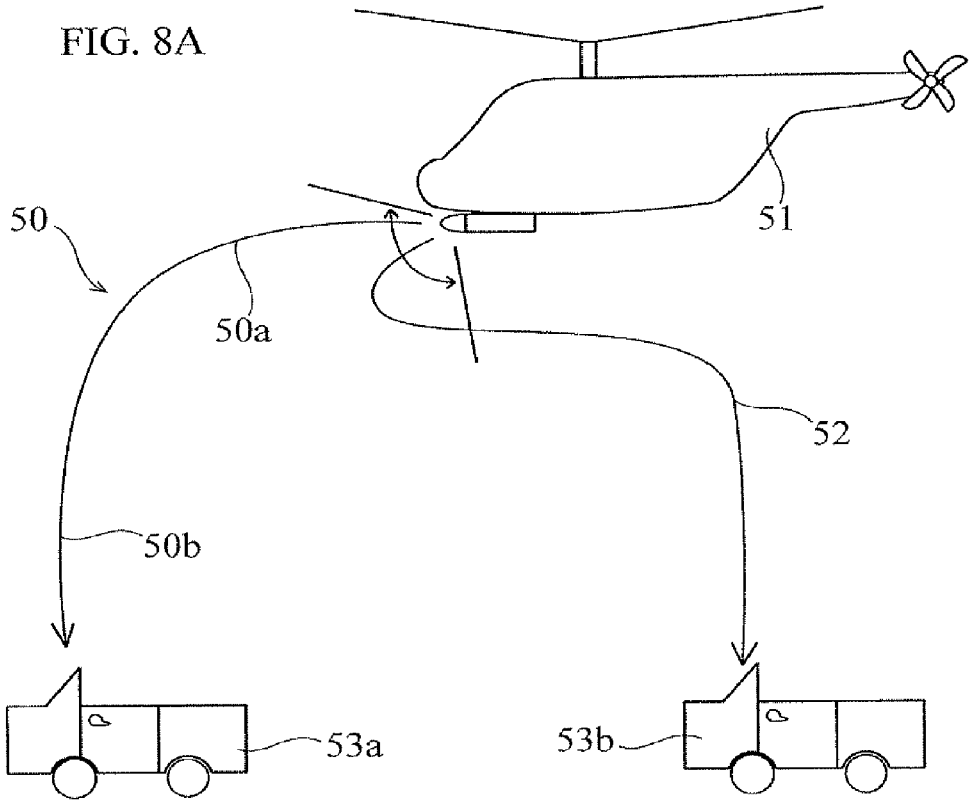
FIG. 8A is a schematic representation of two flight-path types for deployment of the missile of FIG. 1 from a launcher mounted on an airborne platform.
Figure 8B:
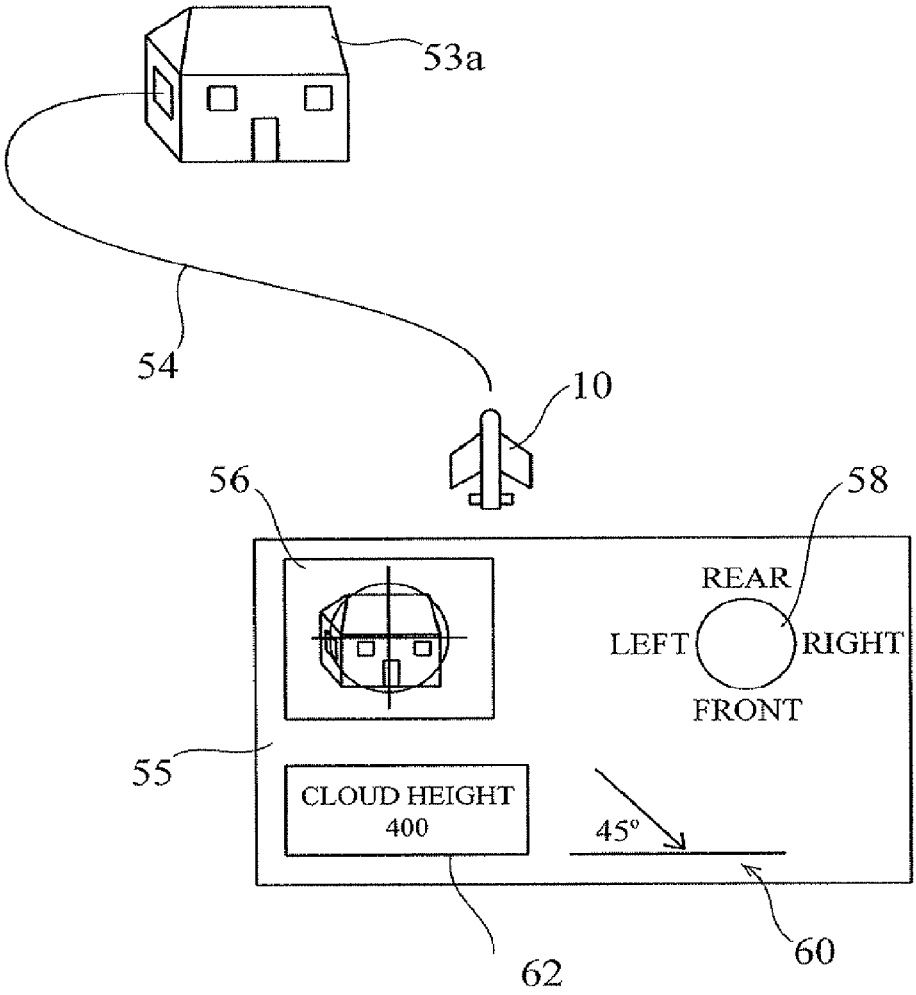
FIG. 8B is a schematic representation of a third flight-path type for deployment of the missile of FIG. 1 from a launcher mounted on an airborne platform, the third flight-path type being defined by a set of parameters including direction of impact and elevation angle at impact.

As already illustrated in the context of surface-to-surface applications, the missile of the present invention may be configured to fly various different types of flight path wherein at least part of certain flight-path types is inertially defined prior to launch. FIGS. 8A and 8B illustrate three preferred flight-path types available for air-to-surface applications.

Specifically, flight path 50 in FIG. 8A is a typical flight path used to navigate towards a target located ahead of the airborne platform. Like in the surface-fired applications described above, the flight path is most preferably defined to achieve a desired incident elevation angle for impact on the target. To this end, the preferred flight path shown has a first cruising portion 50*a* which is relatively flat (i.e., preferably within ±20° of the horizontal) followed by a relatively steep terminal stage of flight 50*b* to achieve an incident elevation angle at the target of more than 75°.

Flight path 52 illustrates the use of an inertially defined initial stage of a flight path to turn rearward (or in any other desired direction) relative to the airborne platform direction. After the missile has turned towards the target, a lock-on-after-launch procedure is used to acquire the target and the flight path then continues in a manner similar to flight path 50. As before, operation of the missile may be networked such that control may be performed from the airborne platform, from a remote controller subsystem, of by any other combination of operators on the network.

Turning now to FIG. 8B, this illustrates a further possible type of flight-path 54 where the operator can define various parameters including one or more of the following: a target location as viewed in the seeker image 56; a direction 58 (compass bearing or direction relative to the launch location) for impact at target; an incident elevation angle 60 for impact at target; and a cloud altitude or other visibility limitation 62 defining a maximum altitude at which sufficient flight time is needed to allow for target verification and/or updating. These parameters provide capabilities similar to those of a cruise missile, allowing an operation to attack a target from a desired direction other than his line of sight and at whatever elevation angle he wants. In contrast to a cruise missile, however, this operation does not necessitate extensive mission planning and preprogramming. Instead, the user can set the parameters by use of a simple graphic user interface such as that shown in FIG. 8B immediately prior to launch.

It should be noted that the features of FIG. 8B and the resultant flight-path type are equally applicable to surface-launched applications, with appropriate adaptations from a descending flight path to an ascending-descending flight path as will be understood by one ordinarily skilled in the art.

Figure 9:
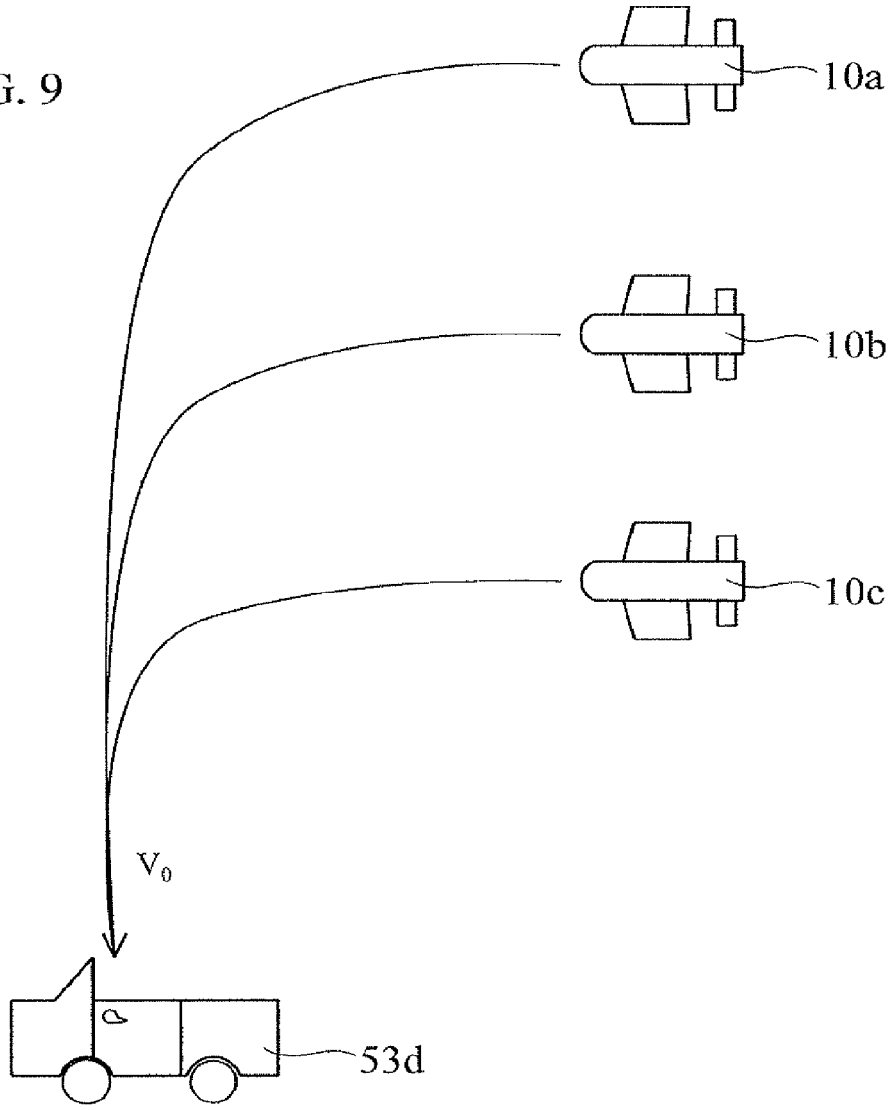
FIG. 9 is a schematic representation of deployment of the missile of FIG. 1 from airborne platforms at different altitudes.

Referring now to FIG. 9, as mentioned earlier, the aerodynamic surfaces of missile 10 are preferably configured such that, during descent through air, a terminal velocity $v_o$ of the missile is subsonic, and more preferably less than 0.5 mach. This feature is of great importance for air-to-surface applications since it renders the altitude of the launch non-critical.

Referring now to FIGS. 10A-12C, in order to facilitate missile 10 locking-on to a target from a launcher mounted on an airborne platform, it is often helpful to allow for movement of the missile canister in order to turn the seeker arrangement so as to be able to image targets at high off-boresight angles relative to the direction of the airborne platform. To this end, particularly preferred implementations of the launcher include: a canister for at least partially containing the missile before launch; and a canister displacement mechanism selectively operable to displace the canister relative to the airborne platform through a motion including a component of rotation so as to facilitate locking on with the seeker arrangement to a target. Two different canister displacement mechanisms are illustrated schematically in FIGS. 10A-10B and 11-12C, respectively.

Referring specifically to FIGS. 10A and 10B, these show a canister displacement mechanism configured for moving the canister with a component of rotation about an axis substantially perpendicular to a central axis of the missile body. This typically turns the entire range of gimbal motion towards the ground and allows the high-angle direction of the seeker arrangement to reach surface targets further behind the airborne platform than would otherwise be within view.

FIG. 11 shows schematically a canister displacement mechanism configured for moving the canister with a component of rotation about an axis substantially parallel to a central axis of the missile body. In an implementation of the seeker arrangement where the side-deflecting gimbal has a significantly smaller range of motion than the main up-down gimbal, this allows the launcher to turn the high-angle gimbal towards a desired target, thereby allowing lock-on to a target at a high off-boresight angle even if the target is not directly below the airborne platform. The effect of this rotation is illustrated schematically as front views in three different states of rotation in FIGS. 12A-12C. It should be noted that this feature is equally applicable to launchers based on other types of platform, such as surface-mounted platforms. It should also be noted that the two types of motion (FIGS. 10A-10B and FIG. 11) may be combined.

Finally, it should be noted that a particularly preferred system based on the missile of the present invention allows use of a single version of the hardware of missile 10 with a wide range of different launchers. This greatly simplifies stocking of different branches of the armed forces, allowing a single armament to be stocked and supplied to multiple branches. However, in order to perform optimally in different applications such as those described, various different modes of operation are required for the different applications.

In order to achieve these different modes of operation without requiring hardware modification, it is a particularly preferred feature of the present invention that the control system of missile 10 includes a programmable data storage device for storing a software component of the control system. In a most preferred case, the missile itself is supplied essentially un-programmed, thereby rendering it non-functional in case it were to be stolen. The required software component for each different type of application is then supplied via a data connection from the corresponding launcher when the missile is loaded into the launcher and prepared for use. Thus, for example, the hand-held launcher 42 of FIG. 6 includes a first version of the software component for configuring the control system to navigate the miniature target-seeking missile according to a first set of navigation rules suited for surface-to-surface applications such as those described with reference to FIGS. 5A-5C and/or a modified surface-to-surface version of FIG. 8B. When missile 10 is loaded into launcher 42, the first software component is loaded into the programmable data storage device and the missile becomes a surface-to-surface missile. Similarly, a launcher for use on an airborne platform includes a second version of the software component for configuring the control system to navigate the miniature target-seeking missile according to a second set of navigation rules suited for the air-to-surface flight paths such as those described with reference to FIGS. 8A and 8B. Here too, the missile becomes an air-to-surface missile by upload of the second version of the software component when loaded into the launcher. Even within the classes of surface-to-surface and air-to-surface, different launchers configured for different operational scenarios may provide corresponding dedicated software components in order to adapt the missile for the corresponding operational scenarios.

It should be noted that the principle of specializing dual-purpose or multi-purpose hardware by uploading of different software components from different launchers is believed to be of patentable significance outside the context of the missile of the present invention, for example, in modifying operation of missile intended for both air-to-air and surface-to-air applications automatically when linked to the corresponding launch system.

It will be appreciated that the above descriptions are intended only to serve as examples, and that many other embodiments are possible within the scope of the present invention as defined in the appended claims.

What is claimed is:

1. A target-seeking missile comprising:

(a) a missile body;

(b) a plurality of aerodynamic surfaces associated with said missile body, said plurality of aerodynamic surfaces including a plurality of control surfaces for controlling roll, pitch and yaw of the missile;

(c) a set of at least three actuators associated with said control surfaces for controlling said control surfaces;

(d) a seeker arrangement associated with said missile body, said seeker arrangement including an imaging sensor mounted on a gimbal mechanism;

(e) a rocket motor associated with said missile body and configured for propelling the missile up to a maximum subsonic speed; and (f) a control system including at least one processor, said control system associated with said seeker arrangement and with said set of actuators, said control system controlling said actuators so as to navigate the missile to a target, wherein said plurality of aerodynamic surfaces and said actuators are configured such that a maximum lateral deflection of the missile flight path achieves a radius of curvature of said flight path smaller than 200 meters.

2. The target-seeking missile of claim 1, wherein said gimbal mechanism has a range of deflection extending in at least one sense to an angle of at least 80 degrees deflection relative to a boresight direction of said missile.

3. The target-seeking missile of claim 1, wherein said gimbal mechanism has a range of deflection which is asymmetric relative to a boresight direction of said missile body, said asymmetric range of deflection extending in one direction to at least about 120 degrees off-boresight.

4. The target-seeking missile of claim 1, wherein said rocket motor is configured for accelerating the missile to a maximum speed of at least 100 meters per second.

5. The target-seeking missile of claim 1, wherein said rocket motor is configured for accelerating the missile to a maximum speed of between 130 and 180 meters per second.

6. The target-seeking missile of claim 1, wherein the missile has a mass of no more than two-and-a-half kilograms.

7. The target-seeking missile of claim 1, wherein said plurality of aerodynamic surfaces includes three sets of at least two control surfaces, each of said sets being independently controlled by one of said actuators for controlling a corresponding one of roll, pitch and yaw of the missile.

8. The target-seeking missile of claim 7, wherein said at least two control surfaces of each set of control surfaces are mechanically linked so as to actuated together by one of said plurality of actuators.

9. The target-seeking missile of claim 7, wherein said at least two control surfaces of each set of control surfaces are deployed symmetrically about a central axis of said missile body.

10. The target-seeking missile of claim 1, wherein said maximum lateral deflection of the missile flight path generates a lateral acceleration of at least 12 G at a speed of 180 meters per second.

11. The target-seeking missile of claim 1, further comprising a warhead deployed within said missile body.

12. The target-seeking missile of claim 1, further comprising an inertial navigation system associated with said processor.

13. The target-seeking missile of claim 12, wherein said processor is configured to navigate the missile after launch according to an inertially defined flight path.

14. The target-seeking missile of claim 1, further comprising a wireless communications link associated with said processor for transmitting images from said imaging sensor to a remote location.

15. The target-seeking missile of claim 1, wherein said plurality of aerodynamic surfaces are configured such that, during descent through air, a terminal velocity of the missile is subsonic.

16. The target-seeking missile of claim 1, wherein said plurality of aerodynamic surfaces include a plurality of folding aerodynamic surfaces assuming a folded state for deployment within a canister and configured to open after launch to a deployed state.

17. The target-seeking missile of claim 1, wherein said control system is configured for navigating the missile along a flight path so as to reach the surface target at an incident elevation angle of greater than 75 degrees.

18. The target-seeking missile of claim 1, wherein said control system is configured to switch between a plurality of modes for navigating the missile to a given surface target along any one of a plurality of flight-path types.

19. The target-seeking missile of claim 18, wherein a first of said flight-path types is configured to achieve a higher maximum altitude than a second of said flight-path types.

20. The target-seeking missile of claim 18, wherein each of said plurality of flight-path types is configured to achieve a corresponding desired incident elevation angle at the surface target.

21. A missile system comprising:

(a) a target-seeking missile including a control system having a programmable data storage device for storing a software component of said control system;

(b) a first launcher for launching said target-seeking missile, said first launcher including a first version of said software component for configuring said control system to navigate said target-seeking missile according to a first set of navigation rules, and a data connection for uploading said first version of said software component into said programmable data storage device; and (c) a second launcher for launching said target-seeking missile, said second launcher including a second version of said software component for configuring said control system to navigate said target-seeking missile according to a second set of navigation rules, and a data connection for uploading said second version of said software component into said programmable data storage device, such that said control system navigates said target-seeking missile according to said first set of navigation rules if launched from said first launcher and according to said second set of navigation rules if launched from said second launcher.

22. The missile system of claim 21, wherein said first launcher is a hand-held launcher, and wherein said first set of navigation rules are configured for surface-to-surface flight paths.

23. The missile system of claim 21, wherein said second launcher is configured for mounting on an airborne platform, and said second set of navigation rules are configured for air-to-surface flight paths.

24. The missile system of claim 21, wherein said target-seeking missile comprises:

(a) a missile body;

(b) a plurality of aerodynamic surfaces associated with said missile body, said plurality of aerodynamic surfaces including a plurality of control surfaces for controlling roll, pitch and yaw of the missile;

(c) a set of at least three actuators associated with said control surfaces for controlling said control surfaces;

(d) a seeker arrangement associated with said missile body, said seeker arrangement including an imaging sensor mounted on a gimbal mechanism; and (e) a rocket motor associated with said missile body and configured for propelling the missile, wherein said control system further comprises at least one processor, said control system being associated with said seeker arrangement and with said set of actuators, said control system controlling said actuators so as to navigate the missile to a target.

25. The missile system of claim 24, wherein said first launcher is a hand-held launcher, and wherein said first set of navigation rules are configured for surface-to-surface flight paths.

26. The missile system of claim 24, wherein said second launcher is configured for mounting on an airborne platform, and said second set of navigation rules are configured for air-to-surface flight paths.

27. The missile system of claim 26, wherein said second set of navigation rules generate flight paths with a cruise portion which is within 20 degrees of horizontal and a terminal portion with an angle of descent greater than 75 degrees.

28. A target-seeking missile comprising:

(a) a missile body;

(b) a plurality of aerodynamic surfaces associated with said missile body, said plurality of aerodynamic surfaces including three sets of at least two control surfaces for controlling roll, pitch and yaw of the missile;

(c) a set of actuators associated with said three sets of control surfaces for independently controlling each of said sets of control surfaces;

(d) a seeker arrangement associated with said missile body, said seeker arrangement including an imaging sensor mounted on a gimbal mechanism;

(e) a rocket motor associated with said missile body and configured for propelling the missile up to a maximum subsonic speed; and (f) a control system including at least one processor, said control system associated with said seeker arrangement and with said set of actuators, said control system controlling said actuators so as to navigate the missile to a target, wherein said plurality of aerodynamic surfaces and said actuators are configured such that a maximum lateral deflection of the missile flight path achieves a radius of curvature of said flight path smaller than 200 meters.

29. A missile system comprising:

(a) a target-seeking missile comprising:

(i) a missile body;

(ii) a plurality of aerodynamic surfaces associated with said missile body, said plurality of aerodynamic surfaces including a plurality of control surfaces for controlling roll, pitch and yaw of the missile;

(iii) a set of at least three actuators associated with said control surfaces for controlling said control surfaces;

(iv) a seeker arrangement associated with said missile body, said seeker arrangement including an imaging sensor mounted on a gimbal mechanism;

(v) a rocket motor associated with said missile body and configured for propelling the missile up to a maximum subsonic speed; and (vi) a control system including at least one processor, said control system associated with said seeker arrangement and with said set of actuators, said control system controlling said actuators so as to navigate the missile to a target, wherein said plurality of aerodynamic surfaces and said actuators are configured such that a maximum lateral deflection of the missile flight path achieves a radius of curvature of said flight path smaller than 200 meters; and (b) a launcher for receiving and launching the missile.

30. The missile system of claim 29, wherein said launcher is a hand-held launcher.

31. The missile system of claim 30, wherein said launcher defines a launching direction of the missile, said control system being configured to select one of a plurality of flight-path types as a function of at least an elevation angle at which said launching direction is held prior to launching of the missile.

32. The missile system of claim 30, wherein said launcher is configured to eject said missile prior to operation of said rocket motor with a momentum no greater than 20 kg·m/s.

33. The missile system of claim 30, wherein said launcher includes an ejector mechanism for ejecting said missile without releasing a rearward flame.

34. The missile system of claim 30, wherein said missile and said launcher further include components of a wireless communications link, and wherein said launcher includes a display for displaying images from said imaging sensor transmitted via said wireless communications link, and wherein said launcher further includes a user input device for updating a currently tracked target within said images for transmission via said wireless communications link as a target update input to said missile.

35. The missile system of claim 30, further comprising a controller subsystem separate from said launcher, said controller subsystem including a display for displaying images output from said imaging sensor and a user input device for updating a currently tracked target within said images.

36. The missile system of claim 35, wherein said controller subsystem and said missile include components of a wireless communications link, transmission of said images from said missile to said controller subsystem and transmission of said user input from said controller subsystem to said missile being performed via said wireless communications link.

37. The missile system of claim 35, wherein said controller subsystem includes a mobile computer, and wherein said user input device includes a click-to-select pointing device.

38. The missile system of claim 29, wherein said launcher is configured for mounting on an airborne platform.

39. The missile system of claim 38, wherein said launcher includes:

(a) a canister for at least partially containing the missile before launch; and (b) a canister displacement mechanism selectively operable to displace said canister relative to the airborne platform through a motion including a component of rotation so as to facilitate locking on with said seeker arrangement to a target.

40. The missile system of claim 39, wherein said motion includes a component of rotation about an axis substantially parallel to a central axis of said missile body.

41. The missile system of claim 39, wherein said motion includes a component of rotation about an axis substantially perpendicular to a central axis of said missile body.

* * * * *